United States Patent [19]

Nagano

[11] Patent Number: 4,511,991

[45] Date of Patent: Apr. 16, 1985

[54] ARITHMETIC OPERATION CIRCUIT FOR FINDING A SQUARE ROOT OF A SUM OF SQUARED VALUES

[75] Inventor: Katsumi Nagano, Shimonoseki, Japan

[73] Assignee: Tokyo Shibaura Denki Kabushiki Kaisha, Japan

[21] Appl. No.: 414,908

[22] Filed: Sep. 3, 1982

[30] Foreign Application Priority Data

Sep. 22, 1981 [JP] Japan ..... 56-149850

[51] Int. Cl.[3] ..... G06G 7/22

[52] U.S. Cl. ..... 364/814; 364/818

[58] Field of Search ..... 364/814, 818, 813; 328/144

[56] References Cited

U.S. PATENT DOCUMENTS 3,870,871 3/1975 Nead ..... 364/814

FOREIGN PATENT DOCUMENTS 1115059 10/1961 Sweden ..... 364/814
398965 1/1974 U.S.S.R. ..... 364/814
452008 4/1975 U.S.S.R. ..... 364/814
822206 4/1981 U.S.S.R. ..... 364/814

OTHER PUBLICATIONS

Stern, T. E. et al., "A Circuit for the Square Root of the Sum of the Squares", Proceedings of the IEEE, 1963, p. 596.

Gilbert, "Translinear Circuits: A Proposed Classification" Electronics Letters, vol. 11, No. 6, (Mar. 20, 1975), p. 136.

Barker et al., "Root-Law Circuit Using Monolithic Bipolar-Transistor Arrays", Electronics Letters, vol. 10, No. 21, (Oct. 17, 1974), pp. 439-440.

*Primary Examiner*—Jerry Smith
*Assistant Examiner*—Michael R. Fleming
*Attorney, Agent, or Firm*—Finnegan, Henderson, Farabow, Garrett & Dunner

[57] ABSTRACT

An arithmetic operation circuit for finding a square root of a sum of squared values having first to fourth transistors is disclosed. The collector of the first transistor is connected to a first current source and the base of the first transistor itself. The collector of the second transistor is connected to the emitter of the first transistor and the base of the second transistor itself, and its emitter is connected to a first power source. The emitter of the third transistor is connected to an output terminal and its base is connected to the collector of the first transistor. The collector of the fourth transistor is connected to the emitter of the third transistor and the base of the fourth transistor itself, and its emitter is connected to a second power source. A difference between the output current flowing into the output terminal and a given current is fed to the collector of the third transistor. A sum of the output current flowing into the output terminal and the given current is fed to the collector of the fourth transistor.

5 Claims, 9 Drawing Figures

ARITHMETIC OPERATION CIRCUIT FOR FINDING A SQUARE ROOT OF A SUM OF SQUARED VALUES

BACKGROUND OF THE INVENTION

The present invention relates to an arithmetic operation circuit for finding a square root of a sum of squared values.

For finding an absolute value of a vector, a function of $\sqrt{X1^2+X2^2}$ is calculated. In the case of a two dimensional vector, two vector components X1 and X2 are each squared and then a square root of their sum is calculated. A bipolar IC for executing such an operation is disclosed in "Root-law Circuit Using Monolithic Bipolar-transistor Arrays", Electronics letters Oct. 17, 1974, Vol. 10, No. 21, pp. 439–440, by R. W. J. Barker and B. L. Hart and in "Transistor Circuits: A Proposed Classification", Electronics Letters, Mar. 20, 1975, Vol. 11, No. 6, pp. 136, by B. Gilbert.

An arithmetic operation circuit for finding a square root of a sum of squared values according to the present invention is based on an idea different from those prior art concepts.

SUMMARY OF THE INVENTION

Accordingly, an object of the present invention is to provide an arithmetic operation circuit for finding a square root of a sum of squared values.

Another object of the present invention is to provide the arithmetic operation circuit attendent with little error.

To achieve the above object, the present invention has the following arrangement. The arithmetic operation circuit is comprised of first to fourth transistors. The first terminal of the emitter-collector path of the first transistor is connected to a first input power source and to the base thereof. The first terminal of the emitter-collector path of the second transistor is connected to a second terminal of the emitter-collector path of the first transistor and to the base of the second transistor itself. The second terminal of the emitter-collector path of the second transistor is connected to a first power source. A first terminal of the emitter-collector path of the third transistor is connected to an output terminal, and its base is connected to the first terminal of the emitter-collector path of the first transistor. The first terminal of the emitter-collector path of the fourth transistor is connected to a second terminal of the emitter-collector path of the third transistor and to the base of the fourth transistor itself. The second terminal of the emitter-collector path of the fourth transistor is connected to the first power source. Means for supplying a different current between an output current flowing into the output terminal and a given current to the first terminal of the emitter-collector path of the third transistor, and supplying a sum current of the output current flowing into the output terminal and the given current to the first terminal of the emitter-collector path of the fourth transistor. As a result, the square of the output current is equal to a sum of the square of the current flowing through the first input power source and the square of the given current.

BRIEF DESCRIPTION OF THE DRAWINGS

Other objects and advantages of the invention will be apparent from the following description taken in connection with the accompanying drawings, in which.

DETAILED DESCRIPTION OF THE PREFERRED EMBODIMENTS

Figure 1:
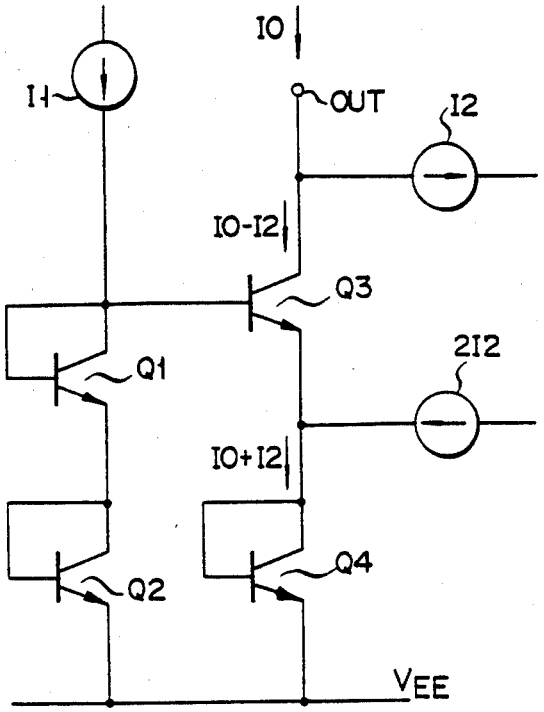
FIG. 1 is a circuit diagram of the first embodiment of an arithmetic operation circuit according to the present invention.

The first embodiment of an arithmetic operation circuit according to the present invention will be described referring to FIG. 1. The operation circuit includes four transistors Q1 to Q4. The collector of the transistor Q1 is connected to an input power source I1 with a current value I1, and to the base of the transistor Q1 itself. The emitter of the transistor Q1 is connected to the collector and base of the second transistor Q2. The emitter of the transistor Q2 is connected to a negative power source $V_{EE}$. The transistor Q3 is connected at the collector to an output terminal OUT for producing an output current I0 and an input current source I2 with a current value I2, and at the base to the node of the collector of the transistor Q1 and the input current source I1, and at the emitter to the collector and base of the transistor Q4. The transistor Q4 is connected at the collector to the input current source 2I2 with a current value 2I2 and at the emitter to the negative power source $V_{EE}$.

A voltage equation of a loop containing transistors Q1 to Q4 in the above circuit, assuming that the base-emitter voltage is $V_{BE}$, is $$V_{BE}(Q1)+V_{BE}(Q2)=V_{BE}(Q3)+V_{BE}(Q4) \quad (1)$$

The collector current Ic of the transistor and the base-emitter voltage $V_{BE}$ are related by $$V_{BE}=V_T\ln(Ic/I_S) \quad (2)$$

where $V_T$ is a thermal voltage and $I_S$ is a reverse bias saturation current. Substituting the equation (2) into the equation (1), we have $$2V_T\cdot\ln\frac{I1}{I_S} = V\cdot\ln\frac{I0-I2}{I_S} + V_T\cdot\ln\frac{I0+I2}{I_S} \quad (3)$$

Therefore, $$I1^2 = (I0-I2)(I0+I2) \quad (4)$$

-continued $$I0 = \sqrt{I1^2 + I2^2}$$

The equation (4) indicates that an absolute value of the vector can be calculated using the FIG. 1 circuit.

In the circuit described above, the first input current I1 is flowed into the collector of the first transistor Q1 and the output current I0 is obtained from the output terminal OUT through the third transistor Q3. The circuit uses a means for setting the collector current of the third transistor Q3 to [I0−I2] and the collector current of the fourth transistor Q4 to [I0+I2] to thereby provide the value of $\sqrt{I1^2+I2^2}$ for the output current I0.

The means for setting the collector currents to [I0−I2] and [I0+I2] will be described referring to FIG. 2. The current sources I2 and 2I2 of FIG. 1 are formed by a current mirror circuit 11 including transistors Q5 and Q6. The collector of the transistor Q5 is connected to the collector of the transistor Q3. Its emitter is connected to the collector of the transistor Q4. The collector of the transistor Q6 is connected to the input terminal IN2 fed with the input current and to the base thereof. Its base is connected to the base of the transistor Q5 and its emitter is connected to the emitter of the transistor Q5.

When the input current I2 is applied to the collector input terminal IN2 of the transistor Q6, the current I2 flows through the collector of the transistor Q5 and the current 2I2 flows through the emitter connection point of the transistors Q5 and Q6. The current of [I0−I2] flows into the collector of the transistor Q3, so that the current of the collector of the transistor Q4 becomes [I0+I2]. Therefore, the current given by the equation (4) flows into the output terminal OUT.

Figure 2:
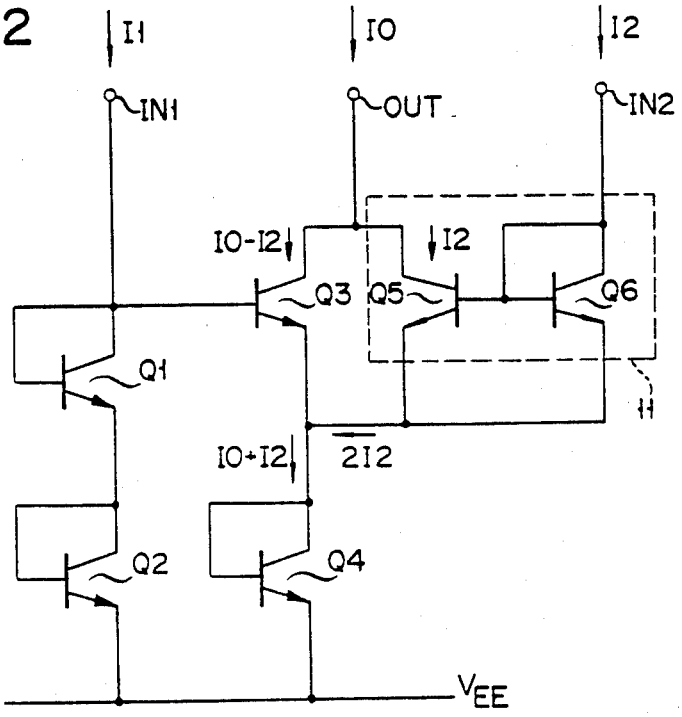
FIG. 2 is a circuit diagram of an arithmetic operation circuit embodying the current feed means shown in FIG. 1.
Figure 3:
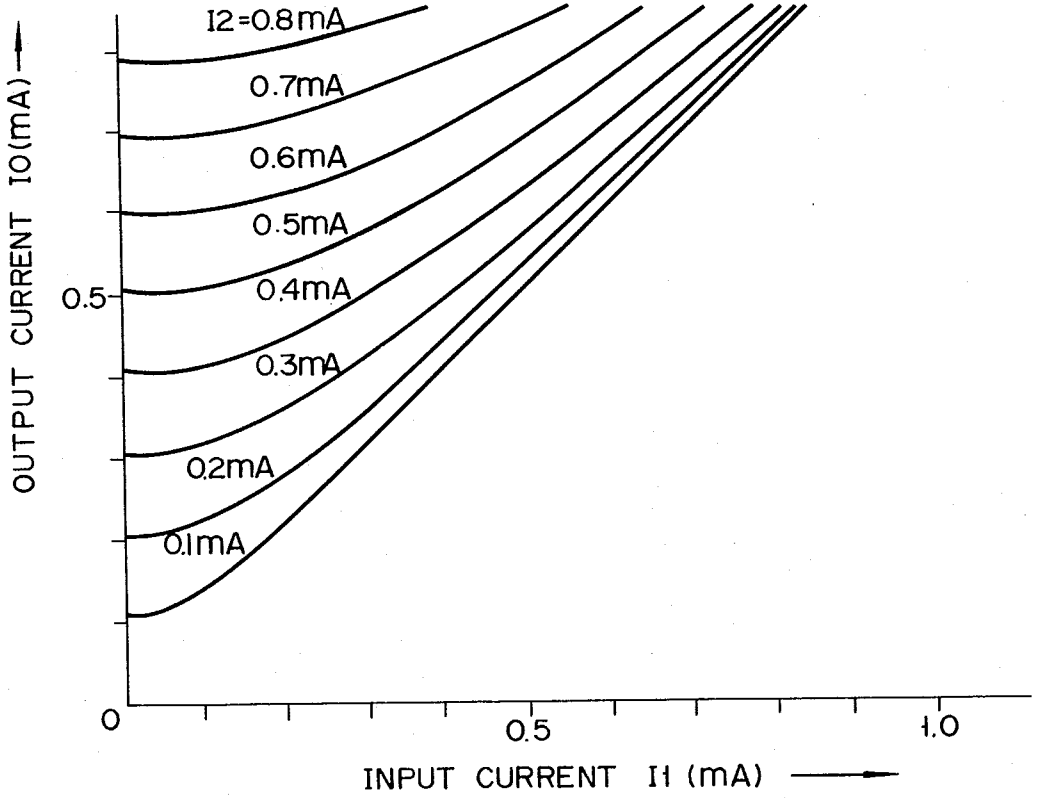
FIG. 3 shows an input vs. output characteristic of the circuit shown in FIG. 2.

A relationship between the input current I1 and the output current I0 when these are measured with the input current I2 as a parameter in the FIG. 2 circuit is shown in FIG. 3. Since the output current I0 can be obtained using the equation $I0=\sqrt{I1^2+I2^2}$, if the input current I2 is constant, the output current becomes [I0→I2] for the input current [I1→0]. Further, when the input current becomes [I1→∞], the output current becomes [I0→I1]. Accordingly, the relationship of the input current I1 vs. output current I0 is represented by a group of curves each having an asymptotic curve I0=I1. Errors of the measured values of the output current I0 for the calculated values are tabulated in the following table. As seen from the table, an accuracy of about 3% is secured in a range of the input currents I1 and I2 from 0.1 mA to 0.5 mA.

TABLE

| Input current I1 | Input current I2 | Output current I0 (measured) | Output current I0 (calculated) | Error |
|---|---|---|---|---|
| 0 mA | 0.1 mA | 0.103 mA | 0.100 mA | 3.0% |
| 0 | 0.2 | 0.205 | 0.200 | 2.5 |
| 0 | 0.3 | 0.306 | 0.300 | 2.0 |
| 0 | 0.4 | 0.406 | 0.400 | 1.5 |
| 0 | 0.5 | 0.505 | 0.500 | 1.0 |
| 0 | 0.6 | 0.600 | 0.600 | 0.0 |
| 0 | 0.7 | 0.695 | 0.700 | −0.7 |
| 0 | 0.8 | 0.790 | 0.800 | −1.3 |
| 0.5 | 0.1 | 0.515 | 0.510 | 1.0 |
| 0.5 | 0.2 | 0.541 | 0.539 | 0.4 |
| 0.5 | 0.3 | 0.582 | 0.583 | −0.2 |
| 0.5 | 0.4 | 0.635 | 0.640 | −0.8 |
| 0.5 | 0.5 | 0.695 | 0.707 | −1.7 |

TABLE-continued

| Input current I1 | Input current I2 | Output current I0 (measured) | Output current I0 (calculated) | Error |
|---|---|---|---|---|
| 0.5 | 0.6 | 0.760 | 0.781 | −2.7 |
| 0.5 | 0.7 | 0.831 | 0.860 | −3.4 |

The above table also shows that as the input currents I1 or I2 increase, the measured values become smaller than the calculated values. Two causes can be considered for the decrease of the output current in a large input current region. The first cause is that since the available maximum current of the collector current of the transistors used in the experiment is 1.0 mA, the error increased with the increase of the input and output currents I1 and I0. The second cause is that in a large current region the current amplification factor $\beta$ of the transistor tends to reduce, and hence the error increases with the base current flowing into the transistor Q3. The problem arising from the latter cause can be solved by modifying the circuit as given below.

Figure 4:
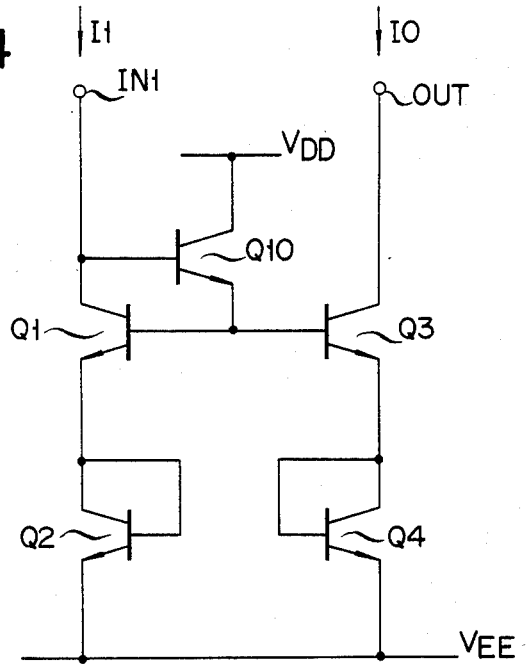
FIG. 4 is a circuit diagram of the second embodiment of an arithmetic operation circuit according to the present invention.

In FIG. 4 illustrating an arithmetic operation circuit, a transistor Q10 for a base current compensation is provided which is connected at the base to the collector of the transistor Q1, and at the emitter to the bases of the transistors Q1 and Q3. The transistor Q10 can reduce the influence by the base current upon the input current I1. While the collector current Ic (Q1) of the transistor Q1 in the FIG. 2 circuit is $I1-I_B(Q1)-I_B(Q3)$, the collector current Ic(Q1) in the FIG. 4 circuit is $$I1 - \frac{1}{\beta}\{I_B(Q1) - I_B(Q3)\}.$$

Therefore, the error due to the base current is $1/\beta$. The output current I0 of the circuit is given by $$\frac{I0^2}{A3 \cdot A4} = \frac{I1^2}{A1 \cdot A2} \quad (5)$$

A1 to A4 indicate emitter areas of the first to fourth transistors Q1 to Q4. As described, the operation circuit shown in FIG. 4 can reduce the error of the output current even in the large input current region.

Figure 5:
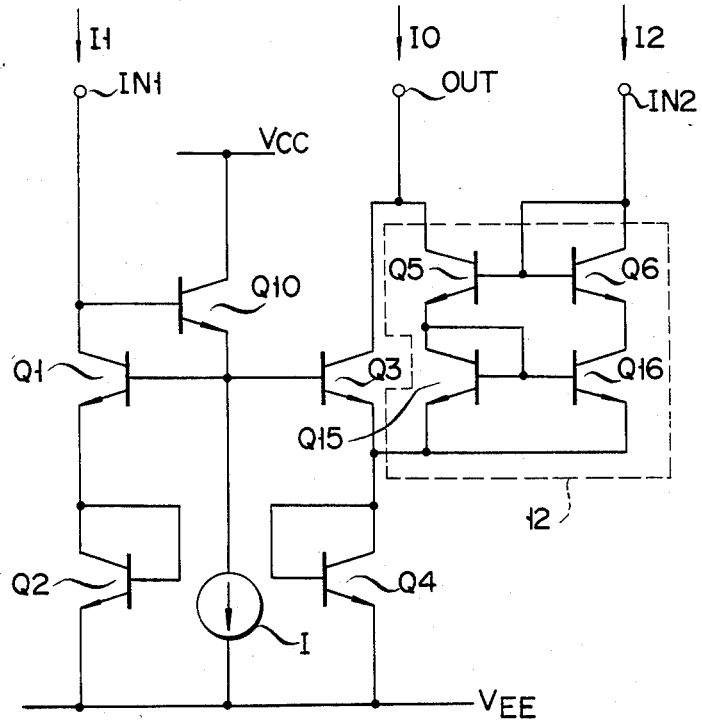
FIG. 5 is a circuit diagram of the third embodiment of an arithmetic operation circuit according to the present invention.

A second embodiment of an arithmetic operation circuit according to the present invention will be described referring to FIG. 5. The circuit shown in FIG. 5 is a modification of the FIG. 2 circuit. The FIG. 5 circuit uses a transistor Q10 of which the emitter-collector path is connected between a positive power source $V_{CC}$ and a node between the transistors Q1 and Q3, and the base is connected to a first input terminal IN1. A current source I is provided between a node between the transistors Q1 and Q3 and a negative power source $V_{EE}$. A current mirror circuit 12 containing transistors Q5, Q6, Q15 and Q16 is connected between an input terminal IN2 and the collector and the emitter of the transistor Q3. The transistors Q5 and Q6 in the current mirror circuit 12 are arranged as in the FIG. 2 embodiment. The transistor Q15 is connected at the collector to the emitter of the transistor Q5, at the base to the collector of the transistor Q15 itself, and at the emitter to the collector of the transistor Q4. The transistor Q16 is connected at the collector to the emitter of the transistor Q6, at the base to the base of the transistor Q15, and at the emitter to the collector of the transistor Q4. Also in this circuit, a current [I0−I2] flows through the collector of the transistor Q3, and a current [I0+I2] flows into the collector of the transistor Q4. Therefore, the influence by the base current is reduced by the provision of the transistor Q10, and more accurate collector currents can be obtained from the transistors Q3 and Q4 by the current mirror circuit 12. Consequently, the error of the output current in the large input current region can be reduced.

Figure 6:
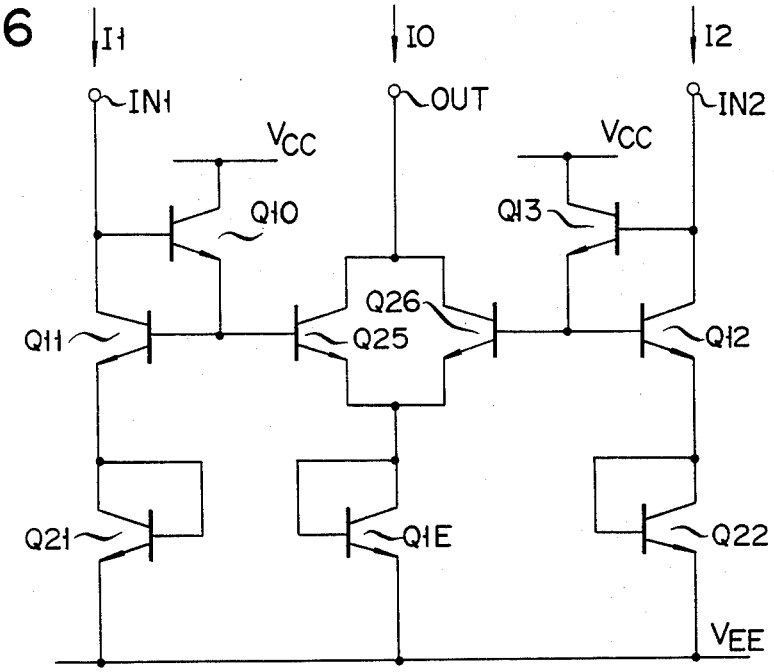
FIGS. 6 and 7 are circuit diagrams of arithmetic operation circuits according to the present invention which are improved over the prior circuit.

FIG. 6 shows a circuit improving over the circuit as disclosed in "Root-law Circuit Using Monolithic Bipolar-transistor Arrays", Electronics Letters, Oct. 17, 1974, Vol. 10, No. 21, pp. 439–440 by R. W. J. Barker and B. L. Hart, to which reference has previously been made. This circuit also has a transistor Q10 for compensating for the base current of which the emitter-collector path is connected between the positive power source $V_{CC}$ and the bases of the transistors Q11 and Q25, and the base is connected to the input terminal IN1. Another base current compensating transistor Q13 is provided of which the emitter-collector path is connected between the positive power source $V_{CC}$ and the bases of the transistors Q12 and Q26, and the base is connected to the input terminal IN2. The transistors Q11 and Q21 are provided of which the emitter-collector paths are connected in series between the input terminal IN1 and the negative power source $V_{EE}$. The collector of the transistor Q21 is connected to the base of that transistor itself. Provided between the input terminal IN2 and the negative power source $V_{EE}$ are transistors Q12 and Q22 of which the emitter-collector paths are connected in series. The collector of the transistor Q22 is connected to the base of that transistor itself. The transistor Q25 is connected at the collector to the collector of the transistor Q26 and at the emitter to the emitter of the transistor Q26. The transistors Q25 and Q26 are connected at the collectors to the output terminal OUT and at the emitters to the negative power source $V_{EE}$ through the emitter-collector path of the transistor $Q_{1E}$. The collector of the transistor $Q_{1E}$ is connected to the base of that transistor itself.

Figure 7:
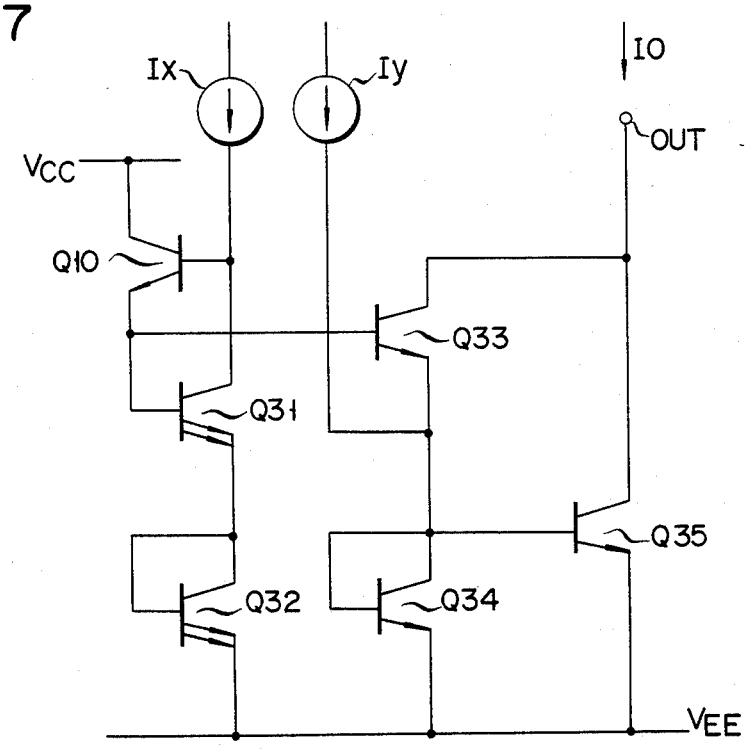

Turning now to FIG. 7, there is shown a circuit as an improvement of the circuit as disclosed in "Translinear Circuits: A Proposed Classification", Electronics Letters, Mar. 20, 1975, Vol. 11, No. 6, pp. 136 by B. Gilbert, to which reference has been previously made. The FIG. 7 circuit uses a base current compensating transistor Q10 of which the emitter-collector path is connected between the positive power source $V_{CC}$ and the node between the bases of transistors Q31 and Q33, and the base is connected to the node between the collector of the transistor Q31 and a current source $I_X$. Transistors Q31 and Q32 are provided, the emitter-collector paths of which are connected in series between the input current $I_X$ and the negative power source $V_{EE}$. The collector of the transistor Q32 is connected to the base of the transistor Q32 itself. Transistors Q33 and Q34 of which the emitter-collector paths are connected in series are provided between the output terminal OUT and the negative power source $V_{EE}$. The collector of the transistor Q34 is connected to a current source $I_Y$ and the base of that transistor itself. The emitter-collector path of the transistor Q35 is connected between the output terminal OUT and the negative power source $V_{EE}$. The base of the transistor Q35 is connected to the collector of the transistor Q34.

Arithmetic operation circuits shown in FIGS. 6 and 7 can reduce the error of the output current in the large input current region, as in the embodiments described above.

Figure 8:
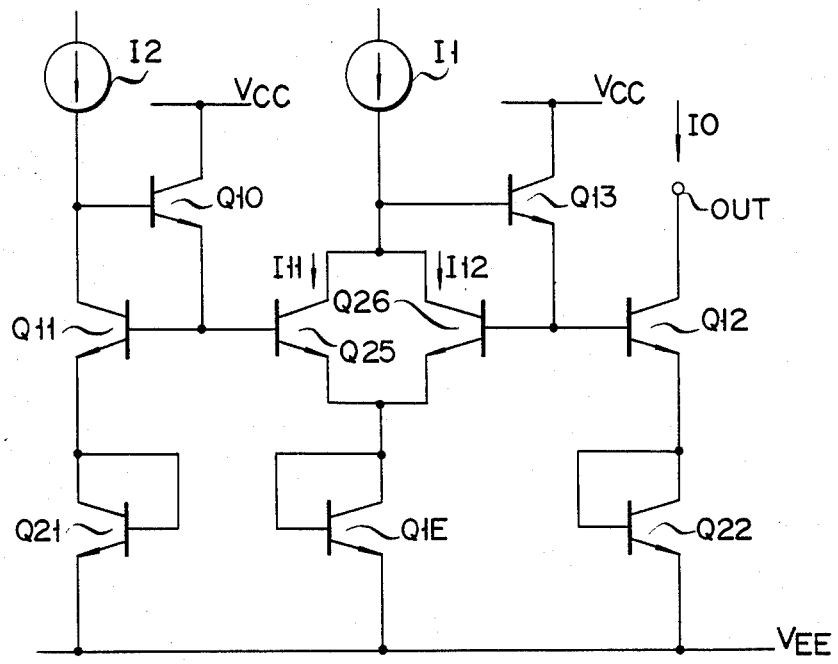
FIG. 8 is a circuit diagram of a modification of the circuit in FIG. 6.

A modification of the circuit in FIG. 6 will be described referring to FIG. 8. Base current compensating transistors Q10 and Q13 are provided as shown in FIG. 8. The current source I2 with the input current I2 is connected to the collector of the transistor Q11, and the current source I1 of input current I1 is connected to the connection point of the collectors of transistors Q25 and Q26. The output current I0 is derived from the collector of the transistor Q12.

In this circuit, assuming that the collector currents of the transistors Q25 and Q26 are I11 and I12, the following relations hold:

$$I2^2 = I11 \cdot I1 \tag{6}$$

$$I0^2 = I12 \cdot I1 \tag{7}$$

$$I1 = I11 + I12 \tag{8}$$

From the equations (6), (7), (8), we have $I1 = I2^2/I1 + I0^2/I1$. Accordingly, the output current I0 can be obtained as $I0 = \sqrt{I1^2 - I2^2}$. This circuit can reduce the error of the output current in the large current region, as in the circuits described above.

Figure 9:
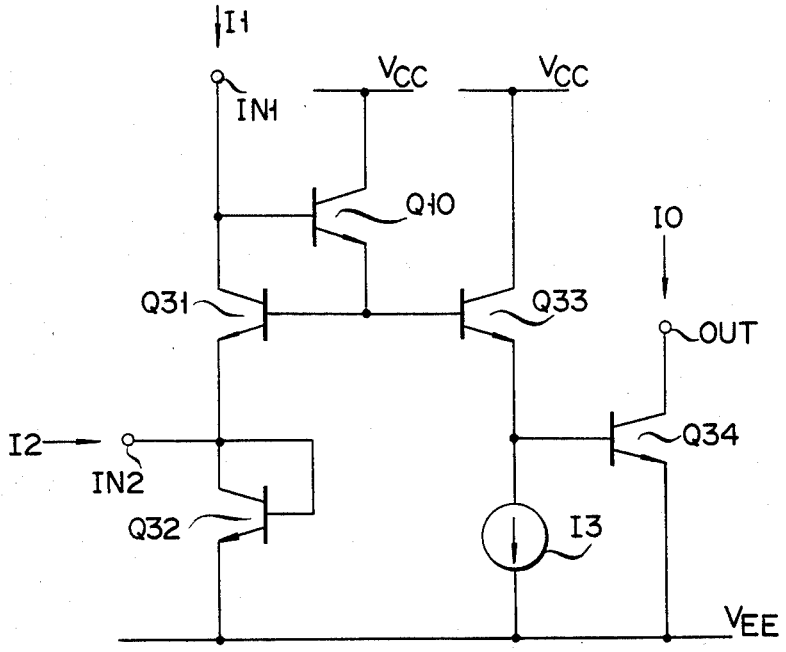
FIG. 9 is a circuit diagram of an application of an arithmetic operation circuit according to the present invention.

An application of an arithmetic operation circuit according to the invention will be described referring to FIG. 9. This circuit is made up of transistors Q31, Q32, Q33, Q34 and Q10. The transistors Q31 and Q32 of which the emitter-collector paths are connected in series are provided between the input terminal IN1 and the negative power source $V_{EE}$. The node between the emitter of the transistor Q31 and the collector of the transistor Q32 is connected to the input terminal IN2, and also to the base of the transistor Q32. The collector of the transistor Q33 is connected to the positive power source $V_{CC}$, its base is connected to the base of the transistor Q31, and its emitter is connected to the negative power source $V_{EE}$ through the current source I3, and also to the base of transistor Q34. The collector of the transistor Q34 is connected to the output terminal OUT, and the emitter is connected to the negative power source $V_{EE}$. The collector of the transistor Q10 is connected to the positive power source $V_{CC}$, the base is connected to the input terminal IN1, and the emitter is connected to the node between the bases of transistors Q31 and Q33.

In this circuit the current equation is given by $$\frac{I1}{A1} \cdot \frac{I1 + I2}{A2} = \frac{I3}{A3} \cdot \frac{I0}{A4} \tag{9}$$

From the equation (9), we have $$I0 = \frac{A3 \cdot A4}{A1 \cdot A2} \cdot \frac{I1(I1 + I2)}{I3} \tag{10}$$

This circuit can also reduce the error caused when fed with a large input current, as in the embodiment described above. The output current I0 is determined by the co-efficient of a ratio of the emitter areas A1 to A4, as shown in the equation (10).

What is claimed is:

1. An arithmetic operation circuit for delivering an output current corresponding to a square root of a sum of two squared values, said values being represented by current delivered from first and second current sources, comprising:

a first transistor having an emitter-collector path connected at one end thereof to the first current source and to the base of said first transistor;

a second transistor having an emitter-collector path connected at one end thereof to the other end of the emitter-collector path of said first transistor and to the base of said second transistor, the other end of the emitter-collector path of said second transistor being connected to a first power source;

a third transistor having an emitter-collector path connected at one end thereof to an output terminal, the base of said third transistor being connected to said one end of the emitter-collector path of said first transistor;

a fourth transistor having an emitter-collector path connected at one end thereof to the other end of the emitter-collector path of said third transistor and to the base of said fourth transistor, the other end of the emitter-collector path of said fourth transistor being connected to said first power source; and means connected to the second current source and to said third and fourth transistors for delivering a difference current, equal to the output current at the output terminal less the current from the second current source, to said one end of said emitter-collector path of said third transistor and for delivering a summed current, equal to said output current plus the current from the second current source, to said one end of said emitter-collector path of said fourth transistor.

2. An arithmetic operation circuit according to claim 1, wherein said current delivering means is a current mirror circuit.

3. An arithmetic operation circuit according to claim 2, wherein said current mirror circuit comprises:

a fifth transistor having an emitter-collector path connected at one end thereof to said one end of the emitter-collector path of said third transistor, the other end of said emitter-collector path of said fifth transistor being connected to said one end of the emitter-collector path of said fourth transistor; and a sixth transistor having an emitter-collector path connected at one end thereof to the second current source and to the base of said sixth transistor, the other end of the emitter-collector path of said sixth transistor being connected to said other end of the emitter-collector path of said fifth transistor, and the base of said sixth transistor being connected to the base of said fifth transistor.

4. An arithmetic operation circuit according to claim 2, wherein said current mirror circuit comprises:

a fifth transistor having an emitter-collector path connected at one end thereof to said one end of the emitter-collector path of said third transistor;

a sixth transistor having an emitter-collector path connected at one end thereof to the second current source and to the base of said sixth transistor, said base of said sixth transistor being connected to the base of said fifth transistor;

a seventh transistor having an emitter-collector path connected at one end thereof to the other end of the emitter-collector path of said fifth transistor and to the base of said seventh transistor, the other end of the emitter-collector path of said seventh transisitor being connected to said one end of the emitter-collector path of said fourth transistor; and an eighth transistor having an emitter-collector path connected at one end thereof to the other end of the emitter-collector path of said sixth transistor, the other end of the emitter-collector path of said eighth transistor being connected to said other end of the emitter-collector path of said seventh transistor, and the base of said eighth transistor being connected to the base of said seventh transistor.

5. An arithmetic operation circuit according to any one of claims 1 to 4, further comprising:

a base current compensating transistor having an emitter-collector path connected at one end thereof to a second power source and at the other end thereof to the base of said first transistor, the base of said compensating transistor being connected to said one end of the emitter-collector path of said first transistor, said base current compensating transistor reducing the influence of the base current of said first to third transistors upon said output current.

* * * * *